US006202619B1

(12) United States Patent
Keller et al.

(10) Patent No.: US 6,202,619 B1
(45) Date of Patent: Mar. 20, 2001

(54) PISTON WITH A CENTRAL COOLING CHAMBER

(75) Inventors: Klaus Keller, Lorch; Peter Kemnitz, Leutenbach; Carmen Klusch, Ludwigsburg, all of (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 09/530,076

(22) PCT Filed: Aug. 29, 1998

(86) PCT No.: PCT/DE98/02595

§ 371 Date: Apr. 21, 2000

§ 102(e) Date: Apr. 21, 2000

(87) PCT Pub. No.: WO99/23380

PCT Pub. Date: May 14, 1999

(30) Foreign Application Priority Data

Oct. 30, 1997 (DE) ..... 197 47 944

(51) Int. Cl.[7] ..... F02F 3/22
(52) U.S. Cl. ..... 123/193.6
(58) Field of Search ..... 123/193.6; 92/187, 92/238

(56) References Cited

U.S. PATENT DOCUMENTS

| | | | | |
|---|---|---|---|---|
| 3,221,718 | | 12/1965 | Isley . | |
| 4,506,632 | * | 3/1985 | Kanda et al. | 123/193.6 |
| 4,867,119 | * | 9/1989 | Cooper et al. | 123/193.6 |
| 5,144,923 | | 9/1992 | Leites et al. . | |
| 5,653,204 | * | 8/1997 | Shaffer | 123/193.6 |
| 5,778,533 | * | 7/1998 | Kemnitz | 123/193.6 |
| 5,934,174 | * | 8/1999 | Abraham et al. | 123/193.6 |
| 6,026,777 | * | 2/2000 | Kemnita et al. | 123/193.6 |

FOREIGN PATENT DOCUMENTS

| | | |
|---|---|---|
| 1 301 677 | 8/1969 | (DE) . |
| 37 08 376 | 9/1987 | (DE) . |
| 37 17 767 | 12/1988 | (DE) . |
| 37 35 590 | 1/1989 | (DE) . |
| 40 39 754 | 12/1990 | (DE) . |
| 60-30455 | 2/1985 | (JP) . |
| 60-125338 | 8/1985 | (JP) . |
| WO 88/04725 | 6/1988 | (WO) . |
| WO 92/10659 | 6/1992 | (WO) . |
| WO 99/23380 | 5/1999 | (WO) . |

* cited by examiner

*Primary Examiner*—Marguerite McMahon
(74) *Attorney, Agent, or Firm*—Collard & Roe, P.C.

(57) ABSTRACT

The invention relates to a piston with a central cooling chamber. The cooling chamber is located beneath the piston head and is impinged upon by oil. At least the lower wall of the cooling chamber is formed by a plate. The purpose of the invention is to provide a means of fixing the plate to the piston as easily as possible. To this end, the piston has at least one second pin or clamping sleeve situated above the piston pin. The second piston pin or clamping sleeve has a smaller diameter, extends approximately in the direction of the piston pin axis, and is connected to the piston. The plate which forms the lower wall of the cooling chamber is supported against the second piston pin or clamping sleeve.

6 Claims, 2 Drawing Sheets

PISTON WITH A CENTRAL COOLING CHAMBER

The invention relates to a piston for an internal combustion engine, with a piston head and a central cooling chamber located beneath the piston head. Such a piston is known from JP patent 60-125338. The lower wall of the cooling chamber is formed by a sheet metal plate, which is secured on the piston under initial spring tension. In the upper zone of the inner bosses, the sheet metal plate is supported by means of molded-on tabs.

One drawback of said construction is that the sheet metal plate has a complicated shape. Another drawback of the known construction is that it is not possible for strength reasons to provide all pistons with a support surface on the inner bosses for a sheet metal plate that has to be supported.

Another possibility for providing a central cooling space is shown by WO 88/04725, where a sheet metal plate is screwed to the piston in the zone located between the boss supports of an articulated piston. However, substantial expenditure is required in particular for cutting the thread and for safely securing the screws.

Therefore, the invention is dealing with the problem of providing a piston with a central cooling chamber and a sheet metal plate forming the lower wall of the cooling chamber, in connection with which piston the aforementioned drawbacks are not present, and where particularly a simple sheet metal plate suffices to serve as the lower wall of the cooling chamber.

Said problem is solved in connection with pistons of the type specified above by a design with the characterizing features of claim 1 or 5. Advantageous further developments of the invention are the objects of the dependent claims.

The sheet metal plate, which consists of spring steel, is supported and initially tensioned by the pin located above the boss of the pin, so that its ends abut the bridges with a defined force of contact pressure, said bosses connecting the bosses with one another.

FIG. 3 shows that the pin supporting the sheet metal plate can be manufactured in the form of a hollow body, or said pin may consist of full material. Steel is preferably employed as the pin material.

Also, the bore receiving the pin may be designed in the form of a blind bore on one side.

The surfaces contacted by the sheet metal plate need not to be worked.

The position of the sheet metal plate in relation to the piston can be exactly defined at the same time by a corrugation shaped in the plate via which the plate rests against the pin, as compared to plates whose installed position is defined by the contact with the relatively imprecise inner shape of the piston.

The volume of the central cooling chamber can be changed, if need be, by varying the position of the pin supporting the plate in the direction of the longitudinal axis of the piston, and by adapting of the shape of the plate, with no change of the inner form of the piston.

In the direction of the boss supports, the plate has a defined gap or recesses, which permit controlled drainage of the cooling oil. The position of said drainage openings can be advantageously selected, if need be, in such a way that draining oil lubricates also the bore of the piston pin.

It is known from DE 40 39 754 to support a sheet metal part limiting the outer cooling channel by a clamping pin pressed into the boss support, whereby the plate rests on the pin with one face side or edge, causing substantial pressure to be applied to the edge. However, a pin or clamping pin extending between the two boss supports, against which the plate is supported over its entire width as defined by the invention, cannot be derived from the above known construction.

The invention is explained in greater detail in the following with the help of an exemplified embodiment. In the drawing, FIG. 1 shows a cross section through a piston as defined by the invention viewed in the direction of the piston pin.

Figure 1:
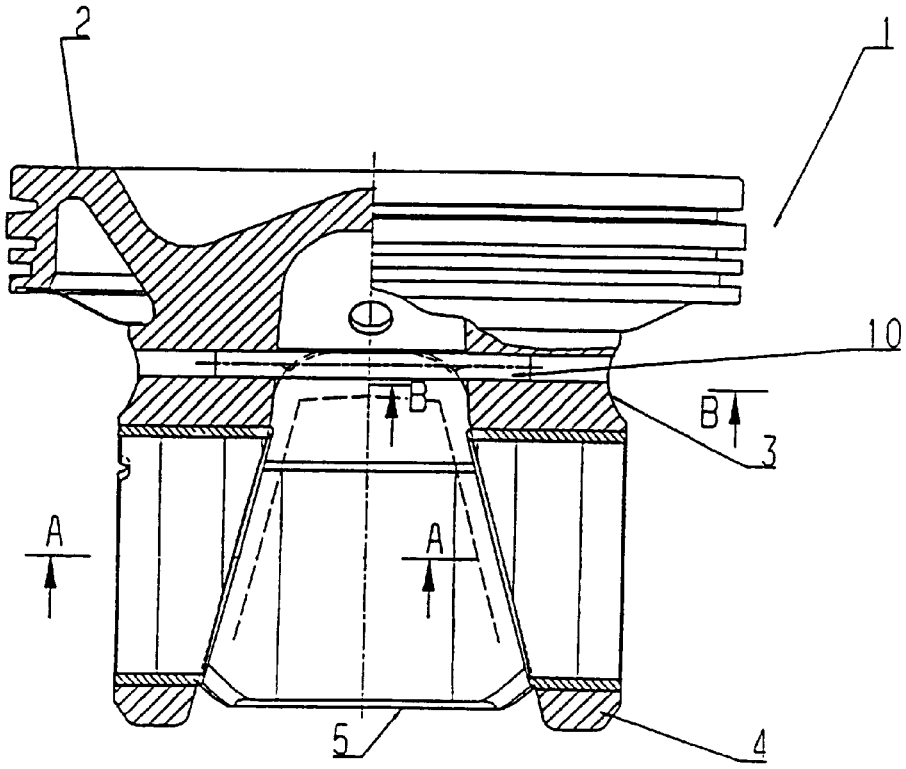
Figure 2:
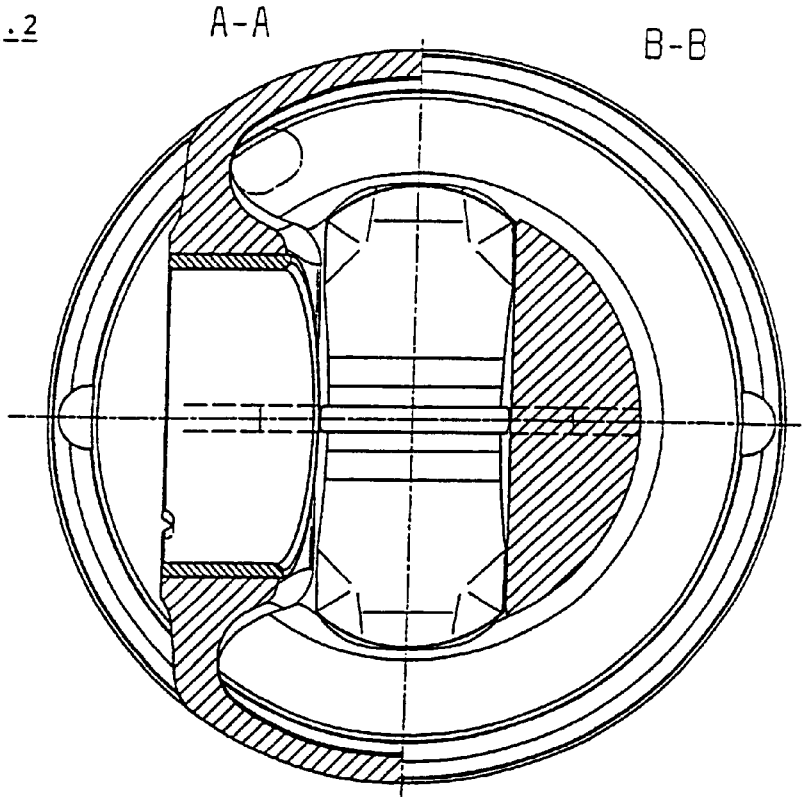
FIG. 2 is a bottom view of the piston as defined by the invention.
Figure 3:
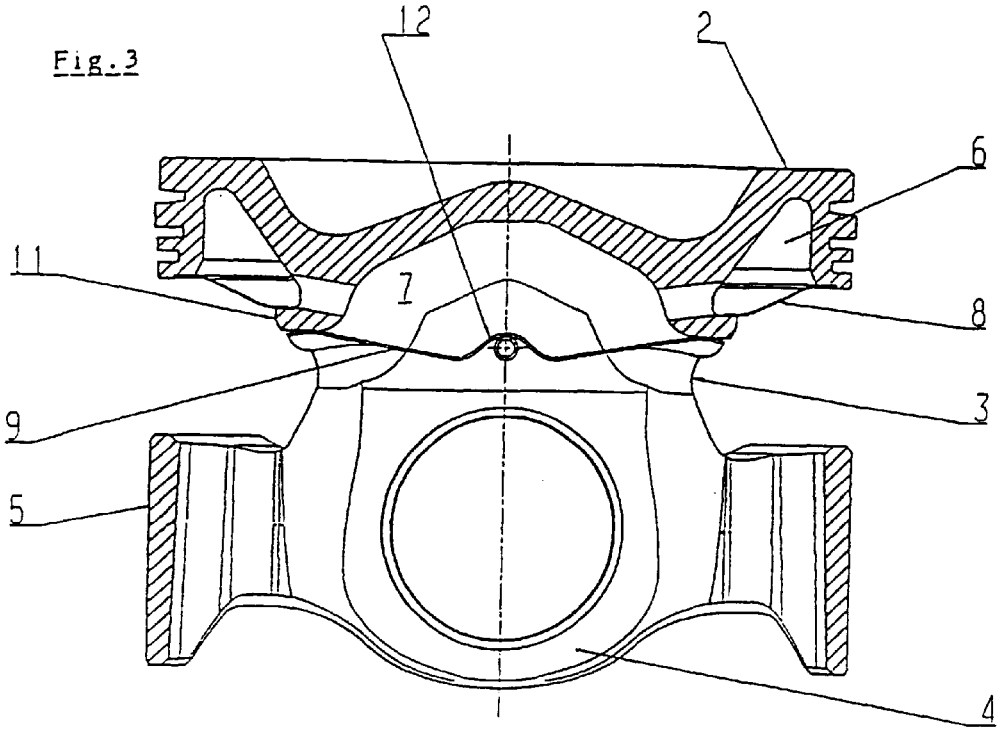
FIG. 3 is a cross section in the pressure-counter pressure direction.

An oil-cooled piston 1 has a piston head 2, the bosses 4 connected as one piece with said piston head by the boss supports 3, and a piston skirt 5. An outer piston channel 6 and a central piston chamber 7 are molded into the piston head 2, said piston channel and said central piston chamber being terminated by the plates 8 and 9. The cooling oil is admitted via the outer cooling channel 6, flows through bores into the central cooling chamber 7, and drains from the central cooling chamber through a defined gap between the plate 9 and the boss support 3.

The plate 9 terminating the central cooling chamber 6 is elastically pressed upwards against the bridges 11 connecting the boss supports 3, by a pin 10 pressed into the boss supports 3 above the eye of the pin, whereby the pin 10 is disposed in a corrugation 12 of the plate 9. This assures exact positioning of the plate in relation to the piston. Within the zone of its ends, the plate is adapted to the contour of the bridges 11 and their transitions to the boss supports by drawing the corners downwards.

Figure 4:
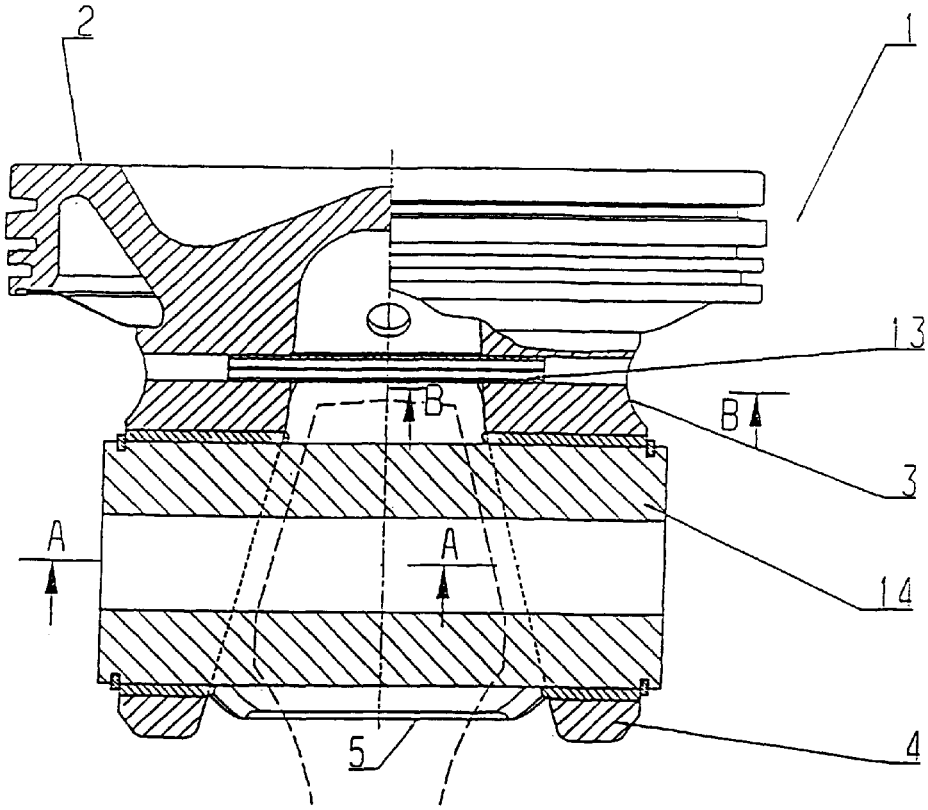
FIG. 4 shows another exemplified embodiment with a clamping sleeve used instead of a pin.

FIG. 4 shows a piston as defined by the invention, in which the plate 9 is supported by means of a clamping sleeve 13 instead of a pin 10. FIG. 4 also shows the piston pin 14, which is basically present in all exemplified embodiments, and a piston rod is indicated.

What is claimed is:

1. A piston (1) for an internal combustion engine, with a piston pin (14) supported in pin bosses, a piston head (2), and having boss supports (3) between Piston head (2) and pin bosses (4) as well as a central cooling chamber (7) located beneath the piston head (2) and being impinged upon by oil, whereby at least the lower wall of the cooling chamber (7) is formed by a sheet metal plate (9) fixed on the piston (1) under initial spring tension, characterized by the following features:

above the piston pin (14), the piston (1) has at least one second pin (10) with a thinner diameter, said second pin being connected with the piston (1) and approximately extending in the direction of the piston pin axis from one boss support to the other boss support;

the plate (10) forming the lower wall of the central cooling chamber (7) is elastically supported on the second pin (10).

2. The piston according to claim 1, characterized in that a corrugation (12) is molded into approximately the center of the plate (9), by which the plate (9) is supported against the second pin (10).

3. The piston according to claim 1, characterized in that the piston head (2) of the piston (1) consists of steel.

4. The piston according to claim 1, characterized by the articulated piston type of construction.

5. A piston (1) for an internal combustion engine, with a piston pin (14) supported in pin bosses, a piston head (2), and having boss supports (3) between piston head (2) and pin bosses (4) as well as a central cooling chamber (7) located beneath the piston head (2) and being impinged upon by oil, whereby at least the lower wall of the cooling chamber (7) is formed by a sheet metal plate (9) fixed on the piston (1) under initial spring tension, characterized by the following features:

above the piston pin (14), the piston (1) has at least one clamping sleeve (13) connected with the piston (1) and approximately extending in the direction of the piston pin axis from one boss support to the other boss support;

the sheet metal plate forming the lower wall of the central cooling chamber (7) is elastically supported on the clamping sleeve (13).

6. The piston according to claim 5, characterized in that a corrugation (12) is molded into approximately the center of the plate (9), said corrugation supporting the plate (9) against the clamping sleeve (13).

* * * * *